US011048196B2

(12) United States Patent
Kunimori

(10) Patent No.: US 11,048,196 B2
(45) Date of Patent: Jun. 29, 2021

(54) IMAGE FORMATION APPARATUS

(71) Applicant: Oki Data Corporation, Tokyo (JP)

(72) Inventor: Osamu Kunimori, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/876,118

(22) Filed: May 18, 2020

(65) Prior Publication Data

US 2020/0379390 A1 Dec. 3, 2020

(30) Foreign Application Priority Data

May 31, 2019 (JP) ..... JP2019-101923

(51) Int. Cl.
*G03G 21/00* (2006.01)
*G03G 15/00* (2006.01)
*G03G 15/20* (2006.01)

(52) U.S. Cl.
CPC ..... *G03G 15/5004* (2013.01); *G03G 15/2039* (2013.01); *G03G 15/2053* (2013.01); *G03G 15/80* (2013.01)

(58) Field of Classification Search
CPC ..... G03G 15/2039; G03G 15/2053; G03G 15/5004; G03G 15/80
See application file for complete search history.

(56) References Cited

FOREIGN PATENT DOCUMENTS

JP 2018-173527 A * 11/2018 ..... G03G 15/20
JP 2018-173529 A 11/2018

* cited by examiner

*Primary Examiner* — Hoang X Ngo
(74) *Attorney, Agent, or Firm* — Metrolex IP Law Group, PLLC

(57) ABSTRACT

An the image formation apparatus according to an embodiment may include: a heater that heats a medium on which a developer image is formed; a controller that controls the heater; a first path through which an input voltage, which is an alternating current (AC) voltage input from an external power supply, is converted to a predetermined voltage, and the predetermined voltage is supplied to the controller; a second path which is branched from the first path and through which the input voltage is supplied to the heater; a control element which is connected to the second path and controls on/off switching of the heater in response to an instruction from the controller; and a disconnection part that disconnects the second path when the input voltage that has a square wave is input.

6 Claims, 12 Drawing Sheets

IMAGE FORMATION APPARATUS

CROSS REFERENCE TO RELATED APPLICATIONS

This application claims priority based on 35 USC 119 from prior Japanese Patent Application No. 2019-101923 filed on May 31, 2019, entitled "IMAGE FORMATION APPARATUS", the entire contents of which are incorporated herein by reference.

BACKGROUND

This disclosure may relate to an image formation apparatus.

An electrophotographic image formation apparatus includes a fixation device including a heat roller which is heated by a heater. An energization of the heater is generally controlled by controlling a switching control element such as a triac so that the temperature of the heat roller reaches a desired temperature.

To activate the image formation apparatus, an alternating current (AC) power source for inputting AC power is needed. In order to operate the image formation apparatus even when a commercial power source goes out, an uninterruptible device may be located outside the image formation apparatus.

In a state where the commercial power source stably supplies AC electric power, the uninterruptable device supplies the electric power from the commercial power source to the image formation apparatus. When detecting that a stoppage of the electric power from the commercial power source due to a power outage, the uninterruptable device converts a stored direct current (DC) power into an AC power and supplies the converted AC power to the image formation apparatus. There may be no problem if the converted AC power supplied from the uninterruptible power supply is not an abnormal AC current. However, if the converted AC power is abnormal such as a square wave, a zero-cross point or timing of the AC power cannot be properly detected so that the heater cannot be properly controlled.

An image formation apparatus disclosed in Patent Document 1 (Japanese Patent Application Publication No. 2018-173529) does not turn on a triac when an abnormality occurs in detection of the zero-crossing point or timing, so as to prevent getting out of control.

SUMMARY

However, in a case where the AC input is changed to an abnormal waveform after the triac, which is a control element to switch energization of the heater, is once turned on, an energization of the triac cannot be turned off even if an energization control signal for the triac is turned off. Accordingly, when the AC input is changed to an abnormal waveform, the power supply to the heater cannot be turned off.

An object of an aspect of one or more embodiments of the disclosure is to safely shut off a power supply to a heater even when a waveform of an input alternative current becomes abnormal.

An aspect of one or more embodiments is an image formation apparatus that may include: a heater that heats a medium on which a developer image is formed; a controller that controls the heater; a first path through which an input voltage, which is an alternating current (AC) voltage input from an external power supply, is converted to a predetermined voltage, and the predetermined voltage is supplied to the controller; a second path which is branched from the first path and through which the input voltage is supplied to the heater; a control element which is connected to the second path and controls on/off switching of the heater in response to an instruction from the controller; and a disconnection part that disconnects the second path when the input voltage that has a square wave is input.

According to the aspect, even when a waveform of an input alternating current becomes abnormal, a power supply to a heater may be safely shut off.

DETAILED DESCRIPTION

Figure 1:
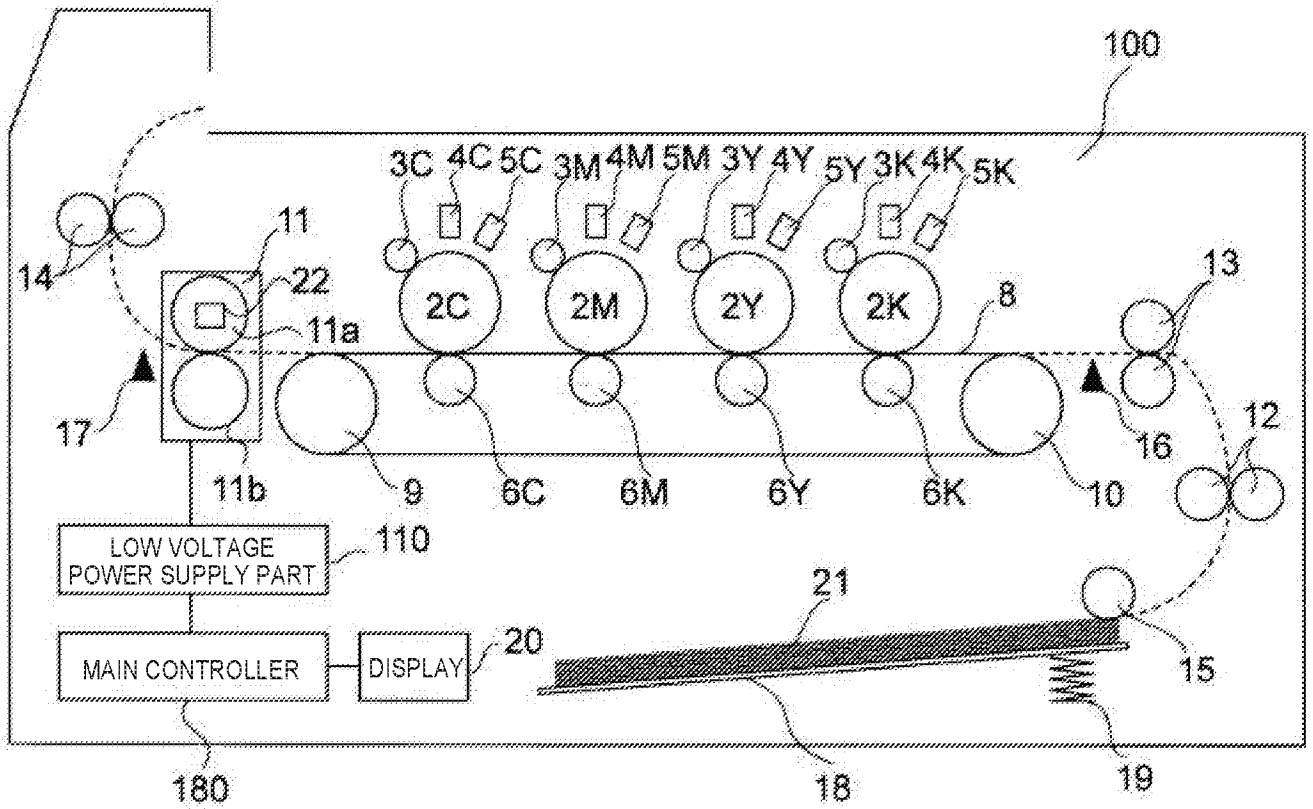
FIG. 1 is a schematic diagram illustrating a vertical sectional view of a configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

FIG. 1 is a schematic diagram illustrating a vertical sectional view of a configuration of an image formation apparatus 100 according to an embodiment. The image formation apparatus 100 according to an embodiment is a color image formation apparatus that prints a color image by superimposing toners of four colors of black, yellow, magenta, and cyan. However, the invention is not limited to this, and may be a black monochrome image formation apparatus, or a color image formation apparatus using other colors.

As illustrated in the figure, the image formation apparatus 100 includes photosensitive drums 2K, 2Y, 2M, and 2C, charging devices 3K, 3Y, 3M, and 3C, exposure devices 4K, 4Y, 4M, and 4C, and development devices 5K, 5Y, 5M, and 5C. The image formation apparatus 100 includes transfer rollers 6K, 6Y, 6M, and 6C, a transfer belt 8, a drive roller 9, an idle roller 10, a fixation device 11, a first conveyance roller 12, a second conveyance roller 13, a discharge roller 14, a hopping roller 15, a write sensor 16, a discharge sensor 17, a support plate member 18, a spring 19, and a display part 20. Further, the image formation apparatus 100 includes a low voltage power supply part 110 and a main controller 180. Note that hereinafter the main controller 180 may be merely referred to as the controller.

In FIG. 1, capital letters "K", "Y", "M", and "C" means black, yellow, magenta, and cyan, respectively. Note that hereinafter, if there is no need to distinguish between these colors, the explanations are made with these capital letters omitted.

Each photosensitive drum 2 is configured to carries thereon an image which is to be transferred. Here the image to be transferred is a toner image serving as a developer image. Each charging device 3 negatively charges the corresponding one of the photosensitive drums 2. Each exposure device 4 writes an electrostatic image to the corresponding one of the photosensitive drums 2. Each development device 5 visualizes the electrostatic image on the corresponding one of the photosensitive drums 2 with the negatively charged toner.

The transfer rollers 6 are provided inside of the transfer belt 8 as an endless belt. Each transfer roller 6 is biased by a bias member such as a spring or the like so as to be pressed toward the corresponding one of the photosensitive drums 2 with the transfer belt 8 being sandwiched between the transfer roller 6 and the photosensitive drum 2.

The transfer belt 8 is supported by the outer circumferential surfaces of the drive roller 9 and the idle roller 10. The transfer belt 8 is stretched between the drive roller 9 and the idle roller 10, so as to have a flat surface thereof in an area where the photosensitive drums 2 are in contact with the transfer belt 8.

The drive roller 9 is connected to an unillustrated driving device and is to be rotated about an axis thereof. When the transfer belt 8 is moved along with the rotation of the drive roller 9, the idle roller 10 rotates, along with the movement of the transfer belt 8, in a direction same as the rotation direction of the drive roller 9.

The fixation device 11 includes a fixation roller 11*a* having a heater 22 therein as a heat source, and a back-up roller 11*b* biased toward the fixation roller 11*a* by a bias member. The fixation device fixes the toner image transferred to a recording medium 21 by heat and pressure. The heater 22 is used to heat the recording medium having the toner image formed thereon.

The dashed line in FIG. 1 indicates a conveyance path of the recording medium 21, Along the conveyance path, the first conveyance roller 12, the second conveyance roller 13, and the write sensor 16 are arranged upstream of the transfer belt 8, and the discharge sensor 17 and the discharge roller 14 are arranged downstream of the fixation device 11.

When the recording medium 21 is conveyed along the conveyance path, the write sensor 16 and the discharge sensor 17 detect predetermined positions of the recording medium 21 (in this example, the write sensor 16 detects the leading end of the recording medium, and the discharge sensor 17 detects the tail end of the recording medium), and transmits the detection signals to the main controller 180.

On the upper surface of the support plate member 18, a stack of the recording media 21 is placed. Under the support plate member 18, the spring 19 serving as a bias member is provided to lift up the support plate member 18. The stacked recording media 21 placed on the support plate member 18 are pressed against the hopping roller 15 by the biasing force of the spring 19. When the hopping roller 15 rotates in a direction to push the recording medium 21 into the conveyance path, the uppermost one of recording media 21 is fed one by one to the conveyance path.

Note that the photosensitive drum 2, the hopping roller 15, the first conveyance roller 12, the second conveyance roller 13, the drive roller 9, the fixation device 11 (the fixation roller and the backup roller), and the discharge roller 14 are connected to the driving device such as a motor or the like, and the driving device is controlled by the main controller 180.

Figure 2:
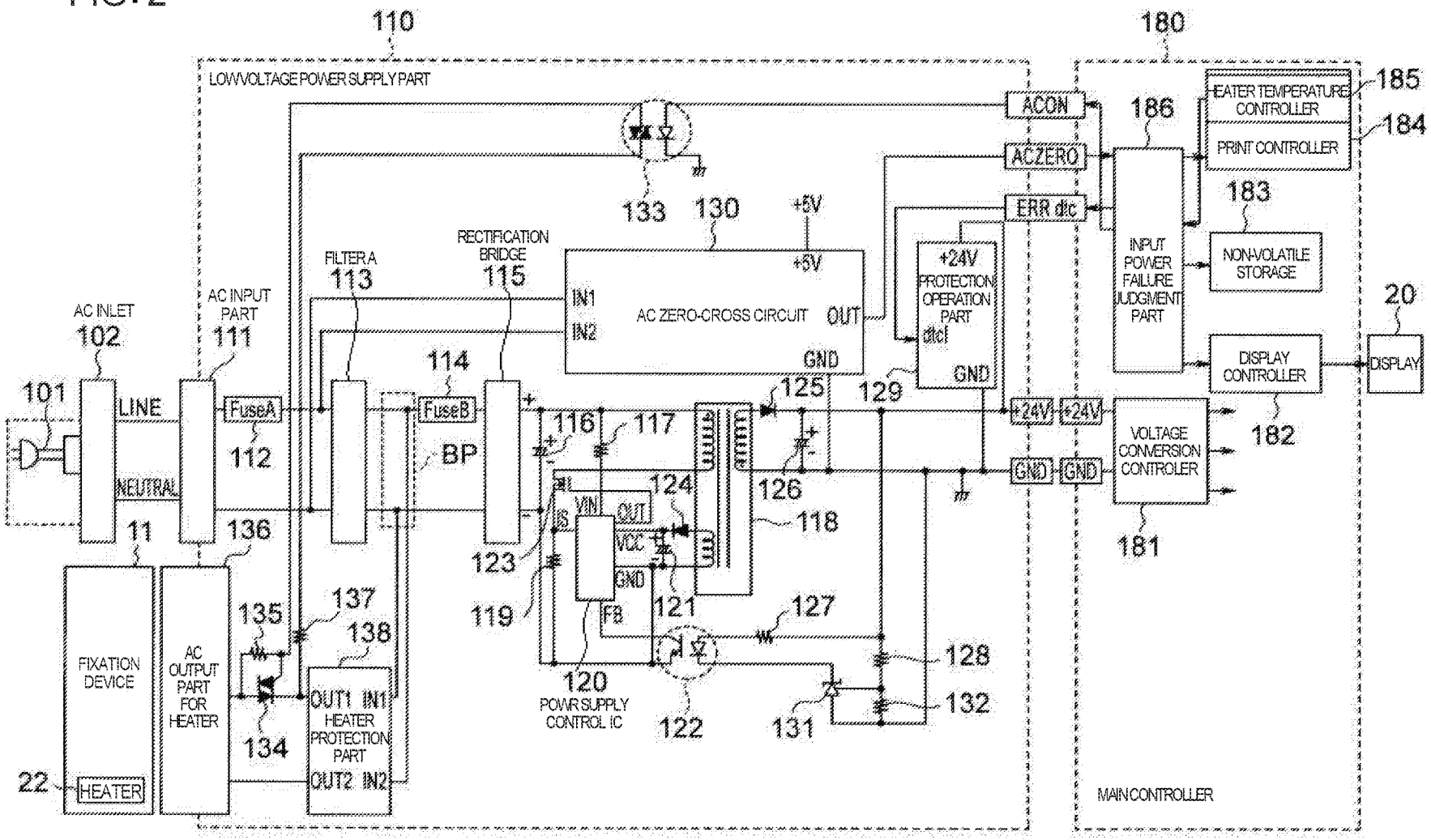
FIG. 2 is a block diagram illustrating schematic configurations of a low voltage power supply part and a main controller of the image formation apparatus.

FIG. 2 is a block diagram illustrating schematic configurations of the low voltage power supply part 110 and the main controller 180 of the image formation apparatus 100 according to an embodiment. In FIG. 2, parts related to features of the low voltage power supply part 110 and the main controller 180 according to an embodiment are excerpted and illustrated.

The power supply cord 101 is connected to a commercial power supply or source (AC power supply or source). The power supply cord 101 is connected to the AC inlet 102, and the AC inlet 102 is connected to the AC input part 111 of the low voltage power supply part 110.

A line side of the AC input part 111 is connected to a fuse A 112. The fuse A 112 is connected to a filter A 113 and an IN2 pin of an AC zero-cross circuit 130. A neutral side of the AC input part 111 is connected to the filter A 113 and an IN1 pin of the AC zero-cross circuit 130.

The filter A 113 is connected to a fuse B 114 and an IN2 pin of a heater protection part 138. The fuse B 114 is connected to an input side of a rectification bridge 115, and the filter A 113 is connected to the input side of the rectification bridge 115 and is connected to an IN1 pin of the heater protection part 138.

A positive electrode of an output side of the rectification bridge 115 is connected to a positive electrode of an electrolytic capacitor 116, a resistor 117, a primary side of a transformer 118. A negative electrode of the output side of the rectification bridge 115 is connected to a negative electrode of the electrolytic capacitor 116, a resistor 119, a GND pin of a power supply control IC 120, a negative electrode of the electrolytic capacitor 121, a third winding side of the transformer 118, and an emitter of a photocoupler 122.

The resistor 117 is connected to a VIN pin of the power supply control IC 120. A source of an FET 123 is connected to the primary side of the transformer 118. A drain of the FET 123 is connected to the resistor 119, an IS pin of the power supply control IC 120. A gate of the FET 123 is connected to an OUT pin of the power supply control IC 120.

The transformer 118 includes a first winding on the primary side, a second winding on the secondary side, and a third winding as an auxiliary winding used for controlling the primary side. The third winding side of the transformer 118 is connected to an anode of a diode 124, and a cathode of the diode 124 is connected to the positive electrode of the electrolytic capacitor 121 and a VCC pin of the power supply control IC 120.

A collector of the photocoupler 122 is connected to a FB pin of the power supply control IC 120. The secondary side of the transformer 118 is connected to an anode of a diode 125, and a cathode of the diode 125 is connected to a positive electrode of the electrolytic capacitor 126, a resistor 127, a resistor 128, a +24V pin of a protection operation part 129 and a +24V output pin of the low voltage power supply part 110.

The secondary side of the transformer 118 is connected to an anode of a variable shunt regulator 131, a negative electrode of the electrolytic capacitor 126, the a resistor 132, a GND pin of the protection operation part 129, and a GND output pin of the low voltage power supply part 110.

An anode of the photocoupler 122 is connected to the resistor 127. A cathode of the photocoupler 122 is connected to a cathode of the variable shunt regulator 131. A reference pin of the variable shunt regulator 131 is connected to the resistor 128 and the resistor 132.

A phototriac 133 is connected to a gate of a triac 134 and a resistor 135. The resistor 135 is connected to the triac 134 and an AC output part 136 for heater. The triac 134 is connected to a resistor 137 and an OUT1 pin of the heater protection part 138. The phototriac 133 is connected to the resistor 137. An OUT2 pin of the heater protection part 138 is connected to the AC output part 136.

The triac 134 is a control element that controls an on/off switching of the heater 22 according to instructions from the main controller 180.

A GND pin of the AC zero-cross circuit 130 is connected to the GND output pin of the low voltage power supply part 110. The OUT pin of the AC zero-cross circuit 130 outputs an AC zero-cross signal. The AC zero-cross signal is input through an ACZERO connector to the main controller 180. Although not illustrated, to a +5V pin of the AC zero-cross circuit 130, a +5V voltage is input, which is generated by a DC-DC converter converting a +24V voltage from a +24V power supply of the low voltage power supply part 110.

The main controller 180 is a control circuit board that controls the image formation apparatus 100. The main controller 180 functions as a controller that controls the heater 22. Note that the main controller 180 exchanges signals with the low voltage power supply part 110 via an ACON connector, the ACZERO connector, and an ERR dtc connector, as illustrated in FIG. 2. Further, the main controller 180 receives the power supply from the low voltage power supply part 110 via the +24V input pin and the GND input pin.

A voltage conversion part 181 generates each power supply (3.3V, 1.8V, etc.) to be used in the logic of the control circuit board from the +24V voltage or the +5 V voltage using a DC-DC conversion circuit. A display controller 182 causes a display of a display part 20 to execute various displays. A non-volatile storage 183 is a storage that stores error information.

A print controller 184 controls printing in the image formation apparatus 100. The print controller 184 includes a heater temperature controller 185. The heater temperature controller 185 controls the triac 134 to cause the triac 134 to perform the on/off switching of the heater 22, so as to control the temperature of the heater 22.

An output of the heater temperature controller 185 is a heater ON signal. The heater ON signal is input into an input power failure judgement part 186 (or input power supply abnormality judgement part), and then input from the input power failure judgement part 186 through the ACON connector to the phototriac 133. Note that the heater ON signal instructs, when the signal is at the high (H) level, to turn on the heater 22, and instructs, when the signal is at the low (L) level, to turn off the heater 22.

The input power failure judgement part 186 receives the AC zero-cross signal from the AC zero-cross circuit 130 via the ACZERO connector, and determines, based on the AC zero-cross signal, whether the waveform of the input voltage, which is an AC voltage input from the commercial power supply as an external power supply, is abnormal.

When the input power failure judgement part 186 determines that the waveform of the input voltage is abnormal in a state where the heater 22 is turned on based on the instruction from the heater temperature controller 185, the input power failure judgement part 186 outputs an fuse cut signal through the ERR dtc connector, to instruct a fuse cut. The fuse cut signal is input to a dtcl pin of the protection operation part 129. The fuse cut signal is to instruct not to perform the fuse cut when the signal is at the L level, and to perform the fuse cut when the signal is at the H level.

Note that the AC zero-cross signal is also supplied from the input power failure judgement part 186 to the print controller 184, and the print controller 184 executes, based on the AC zero-cross signal, phase control of the timing that turns on the heater 22, so as to suppress inrush current or the like.

Note that the wire connected to the IN2 pin of the heater protection part 138 is connected to the wire between the filter A 113 and the fuse B114, and the wire connected to the IN1 pin of the heater protection part 138 is connected to the wire between the filter A 113 and the rectification bridge 115. These connection points are referred as to a branch point BP of the wires. In other words, the image formation apparatus 100 includes: a first path through which the input voltage, which is input to the AC inlet 102 from a commercial power supply, is converted to a desired voltage, and the desired voltage is supplied to the controller 180; and a second path which is branched from the first path at the branch point BP and through which the input voltage is supplied to the heater 22. In the second path, the heater 22, the triac 134, and the heater protection part 138 are connected in series.

Figure 3A:
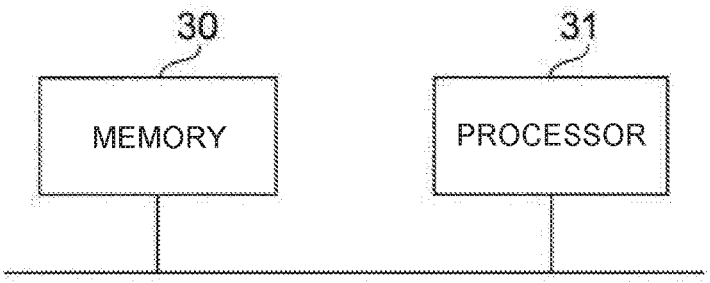
FIGS. 3A and 3B are block diagrams of configurational examples of a hardware of a control-related configuration.

A part or all of the display controller 182, the print controller 184, and the input power failure judgement part 186 may be configured by a memory 30 that stores programs therein and a processor 31 such as a central processing unit (CPU) that executes the programs stored in the memory 30, for example, as illustrated in FIG. 3A. Such programs may be not be stored in the memory 30. That is, such programs may be retrieved through the network from the outside of the image formation apparatus or such programs may be retrieved from a non-transitory tangible data recording medium that is provided outside of the image formation apparatus and stores therein the programs. In other words, such programs may be provided, for example, as a program product.

Figure 3B:
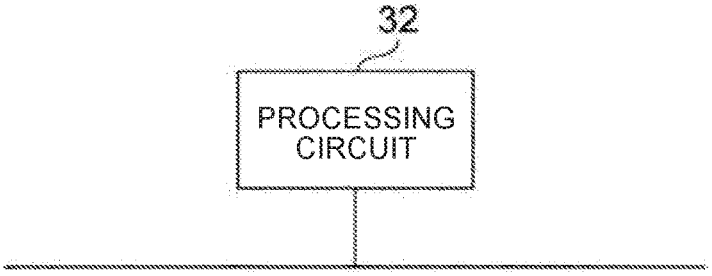

Further, a part or all of the display controller 182, the print controller 184, and the input power failure judgement part 186 may be composed of a processing circuit 32 such as a single circuit, a composite circuit, a programmed processor, a parallel programmed processor, an application specific integrated circuit (ASIC) or a field programmable gate array (FPGA), for example, as illustrated in FIG. 3B. Note that the non-volatile storage 183 may be composed of a non-volatile memory such as an electrically erasable programmable read-only memory (EEPROM), a flash memory, or the like.

Figure 4:
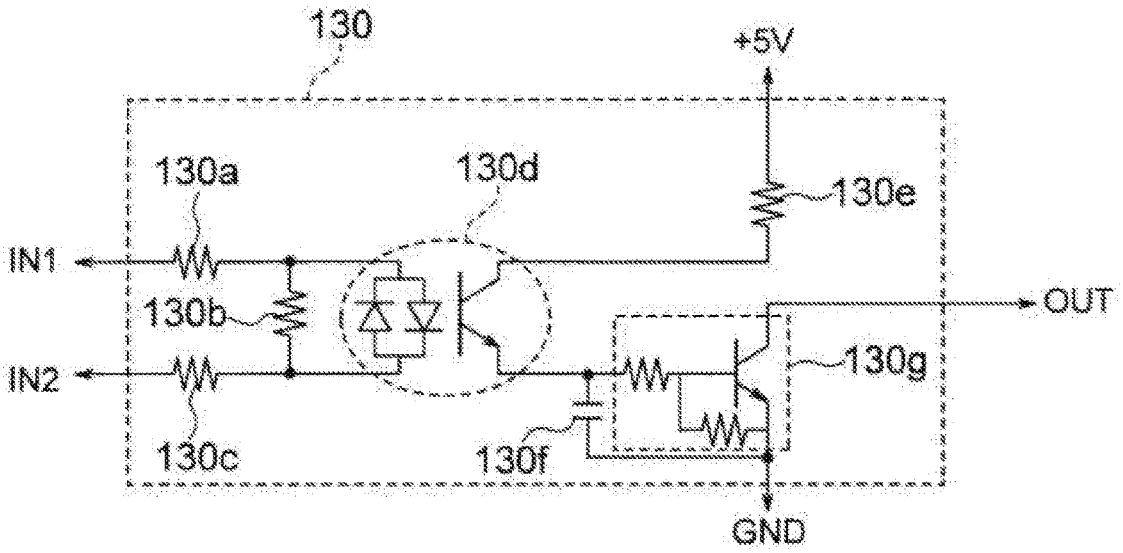
FIG. 4 is a circuit diagram of an example of an AC zero-cross circuit.

FIG. 4 is a circuit diagram of an example of the AC zero-cross circuit 130 according to an embodiment. The AC zero-cross circuit 130 includes a resistor 130*a*, a resistor 130*b*, a resistor 130*c*, a photocoupler 130*d*, a resistor 130*e*, a capacitor 130*f*, and the digital transistor 130*g*.

The resistor 130*a* is connected to the IN1 pin of the AC zero-cross circuit 130. The resistor 130*a* is connected to the resistor 130*b* and the photocoupler 130*d*.

The photocoupler 130*d* is connected to the IN2 pin of the AC zero-cross circuit 130. The photocoupler 130*d* is connected to the resistor 130*e*. The resistor 130*e* is connected to the +5V pin of the AC zero-cross circuit 130. Further, the photocoupler 130*d* is connected to the capacitor 130*f* and a base of the digital transistor 130*g*.

An emitter of the digital transistor 130*g* is connected to the GND pin of the AC zero-cross circuit 130. A collector of the digital transistor 130*g* is connected to the OUT pin of the AC zero-cross circuit 130.

Note that there are several AC zero-cross circuits whose circuit configurations are different from each other. Thus, the AC zero-cross circuit 130 in an embodiment may have a configuration different from the above described configuration. Note that the AC zero-cross circuit 130 functions as an AC zero-cross detector that detects the AC zero-cross points of the input AC voltage.

Figure 5:
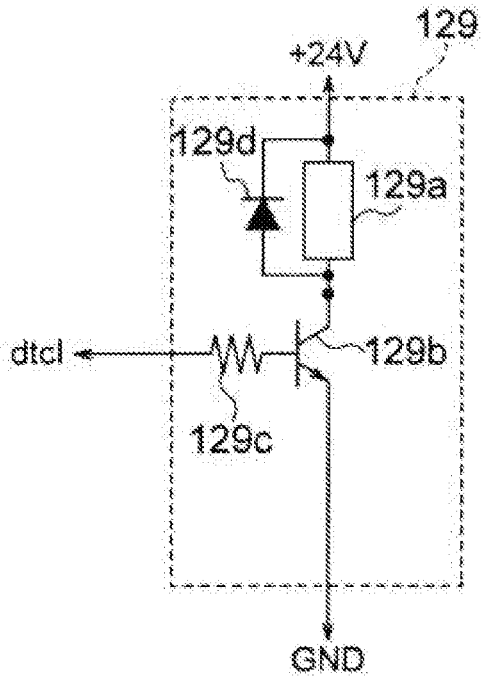
FIG. 5 is a circuit diagram illustrating an example of a protection operation part.

FIG. 5 is a circuit diagram illustrating an example of the protection operation part 129 according to an embodiment. The protection operation part 129 includes a relay coil part 129*a*, a transistor 129*b*, a resistor 129*c*, and a diode 129*d*. The relay coil part 129*a* is connected to a cathode of the diode 129*d*, the +24V pin of the protection operation part 129. The relay coil part 129*a* is connected to an anode of the diode 129*d* and a collector of the transistor 129*b*.

A base of the transistor 129*b* is connected to the resistor 129*c*. The resistor 129*c* is connected to the dtcl pin of the protection operation part 129. An emitter of the transistor 129*b* is connected to the GND pin of the protection operation part 129.

Figure 6:
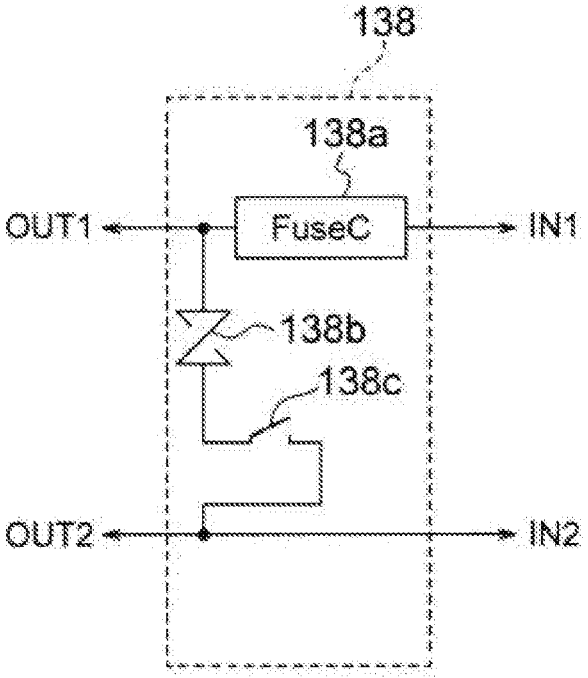
FIG. 6 is a circuit diagram illustrating an example of a heater protection part.

FIG. 6 is a circuit diagram illustrating an example of the heater protection part 138 according to an embodiment. The heater protection part 138 includes a fuse C 138*a*, a varistor 138*b*, and a relay contact point 138*c*.

The fuse C 138*a* is connected to the varistor 138*b* and the OUT1 pin of the heater protection part 138. Further, the fuse C 138*a* is connected to a neutral illustrated in FIG. 2. The fuse C 138*a* is a disconnection part (a cutting part) for disconnecting (cutting) the second path as a supply path of the voltage to the heater 22.

The varistor 138*b* is connected to the relay contact point 138*c*. The relay contact point 138*c* is connected to the OUT2 pin and the IN2 pin of the heater protection part 138.

Figure 7:
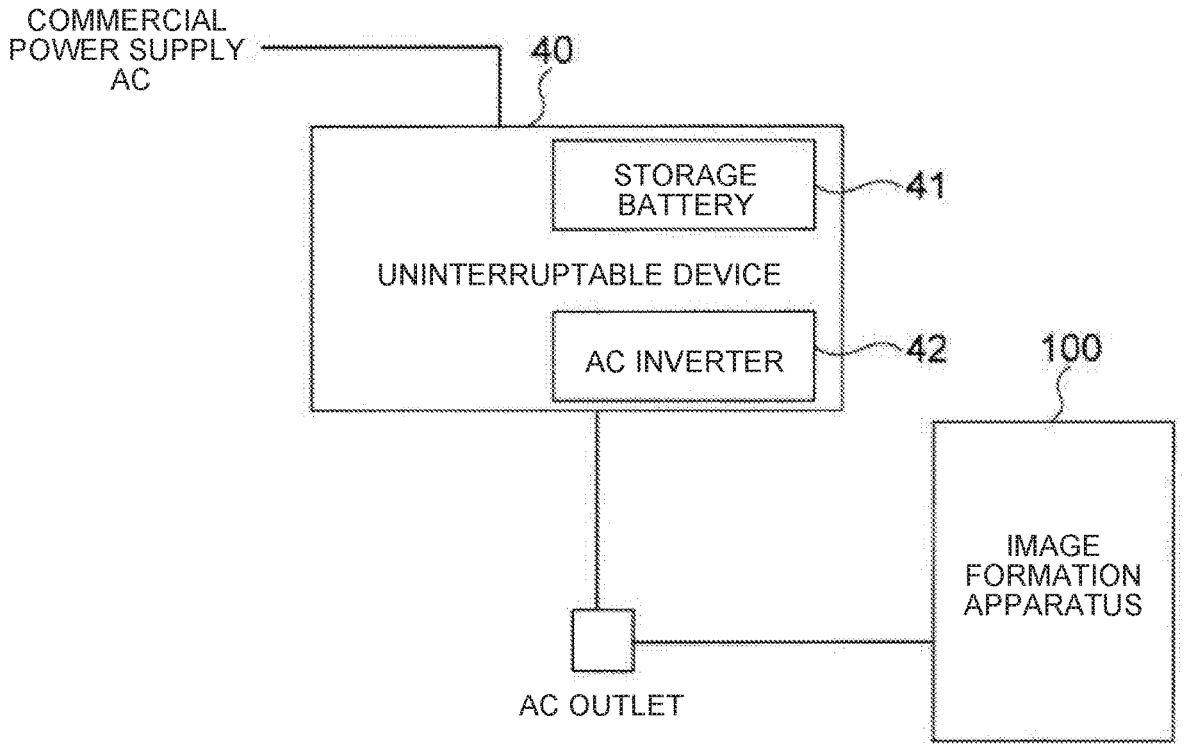
FIG. 7 is a schematic diagram for explaining a system of a commercial power supply connected to the image formation apparatus.

FIG. 7 is a schematic diagram for explaining a system of a commercial power supply connected to the image formation apparatus 100. An uninterruptable device 40 stores the commercial AC power drawn from the outdoor in a storage battery 41 as DC power. When the supply of the commercial AC power is stopped due to a power outage or the like, the uninterruptable device 40 generates AC power from the power stored in the storage battery 41 by an AC inverter 42 and outputs the AC power to the image formation apparatus 100.

Figure 8A:
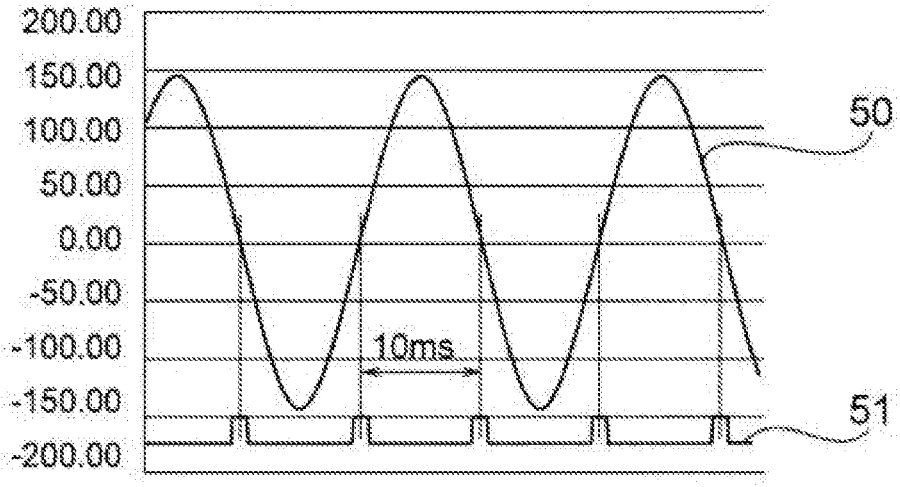
FIGS. 8A to 8C are graphs for explaining a relationship between an AC power signal and a power supply waveform.
Figure 8B:
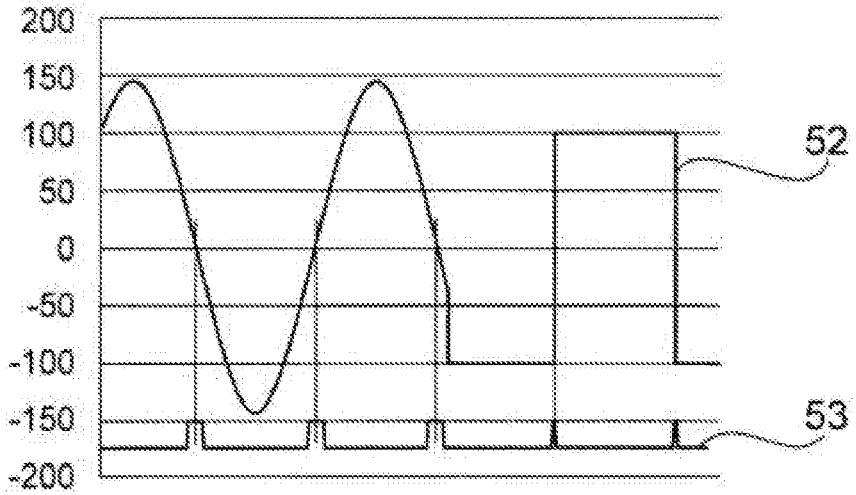
Figure 8C:
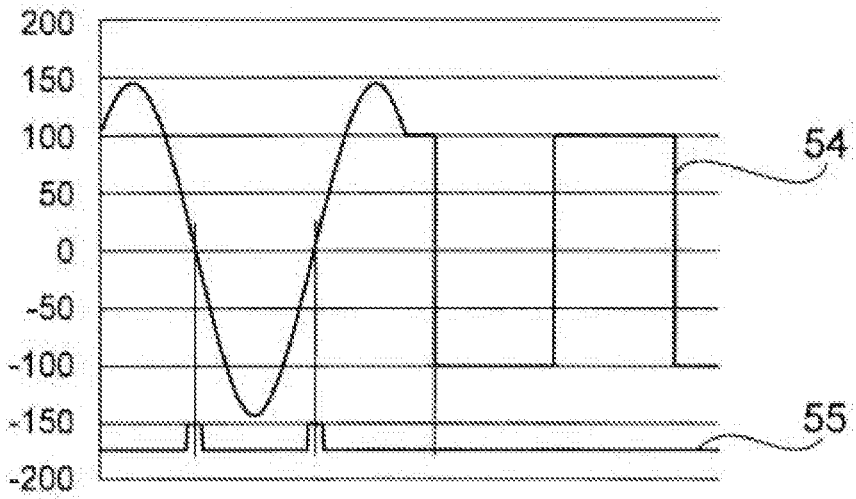

FIGS. 8A to 8C are graphs for explaining a relationship between a power supply waveform and an AC zero-cross signal. In FIGS. 8A to 8C, the vertical axis represents the voltage and the horizontal axis represents the time.

In FIG. 8A, the reference numeral 50 represents a power supply waveform of a normal sine wave of AC 100V/50 Hz, and the reference numeral 51 represents an AC zero-cross signal thereof. As illustrated in FIG. 8A, in the normal state, the H level of the AC zero-cross signal is output constantly at 10 ms (milliseconds) intervals. In other words, the cycle of the AC zero-cross signal is 10 ms. Note that when commercial AC is input, the constant of the AC zero-cross detection circuit is preset so that the pulse width is 500 μs to 1.5 ms.

In FIG. 8B, the reference numeral 52 represents a power supply waveform that is changed from a normal sine wave of AC 100V/50 Hz to a square wave, and the reference numeral 53 represents an AC zero-cross signal thereof. When the power supply waveform is changed to the square wave, the pulse width of the AC zero-cross signal becomes shorter than that of the normal sine wave. Here, the pulse width of the AC zero-cross signal of the square wave power supply is less than 500 μs.

In FIG. 8C, the reference numeral 54 represents a power supply waveform that is changed from a normal sine wave of AC 100V/50 Hz to a square wave, and the reference numeral 55 represents an AC zero-cross signal thereof. The quire wave of the power supply waveform 54 in FIG. 8C has the voltage change steeper than that of the square wave of the power supply waveform 52 in FIG. 8B, and thus the AC zero-cross waveform 55 of the square wave of the power supply waveform 54 has no pulse being outputted.

Here, the pulse width of the AC zero-cross signal is a length of time when the AC zero-cross point is detected. When the time length (the pulse width) is shorter than a threshold, or the AC zero-cross point is not detected, it can be determined that the waveform of the input voltage is abnormal.

Figure 9:
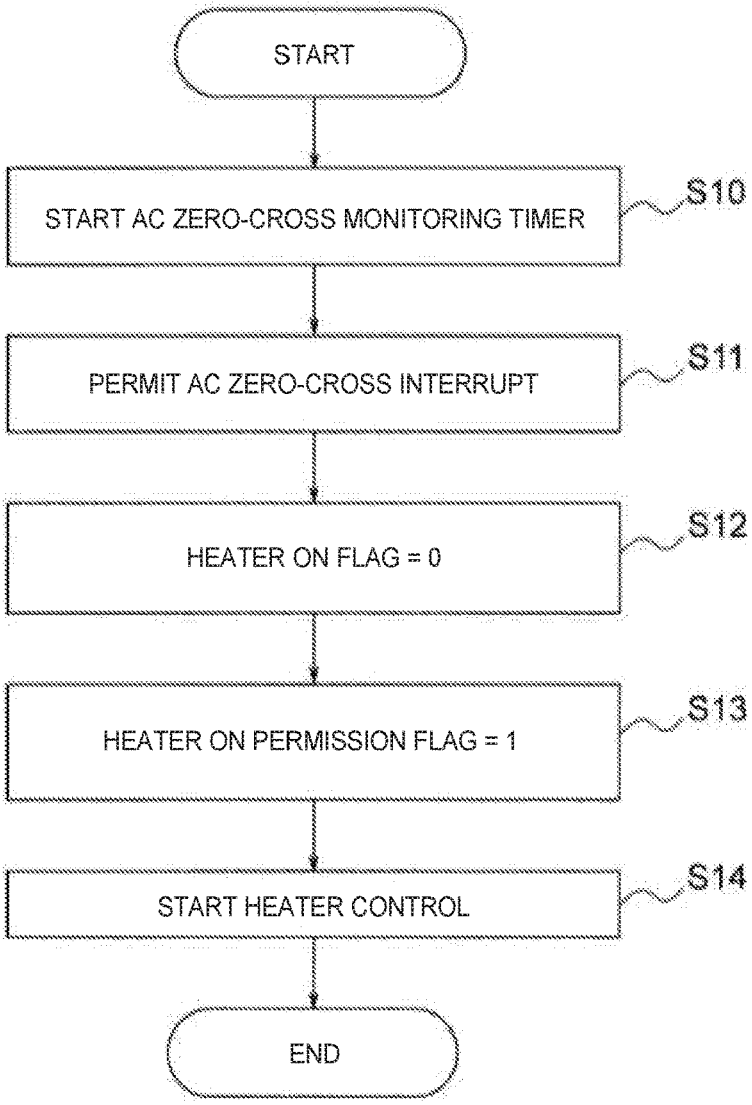
FIG. 9 is a flowchart illustrating an initialization operation of an input power failure judgement part.

FIG. 9 is a flowchart illustrating an initialization operation of the input power failure judgement part 186. First, the input power failure judgement part 186 starts an AC zero-cross monitoring timer, as an initialization operation (step S10). Here, the AC zero-cross monitoring timer is a timer that monitors intervals of the AC zero-cross points.

Next, the input power failure judgement part 186 permits an AC zero-cross interrupt (step S11). With this, the AC zero-cross interrupt, which is described later, is allowed. Next, the input power failure judgement part 186 clears a heater ON flag to be "0" (step S12). The heater ON flag is a flag that indicates whether the heater 22 is turned on or not. When the heater ON flag is "1", the heater 22 is on, and when the heater ON flag is "0", the heater 22 is off.

Next, the input power failure judgement part 186 sets a heater ON permission flag to "1", to permit the heater temperature controller 185 to execute a heater ON control (step S13). The heater ON permission flag is a flag that indicates whether or not the heater 22 can be turned on. When the heater ON permission flag is "1", the heater 22 is allowed to be turned on, and when the heater ON permission flag is "0", the heater is not allowed to be turned on.

Then, the input power failure judgement part 186 starts the temperature control of the heater 22 by the heater temperature controller 185 (step S14).

Figure 10:
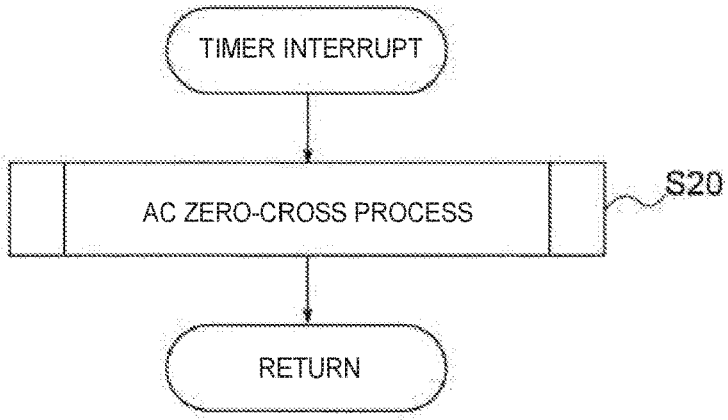
FIG. 10 is a flowchart illustrating a timer interrupt operation.
Figure 11:
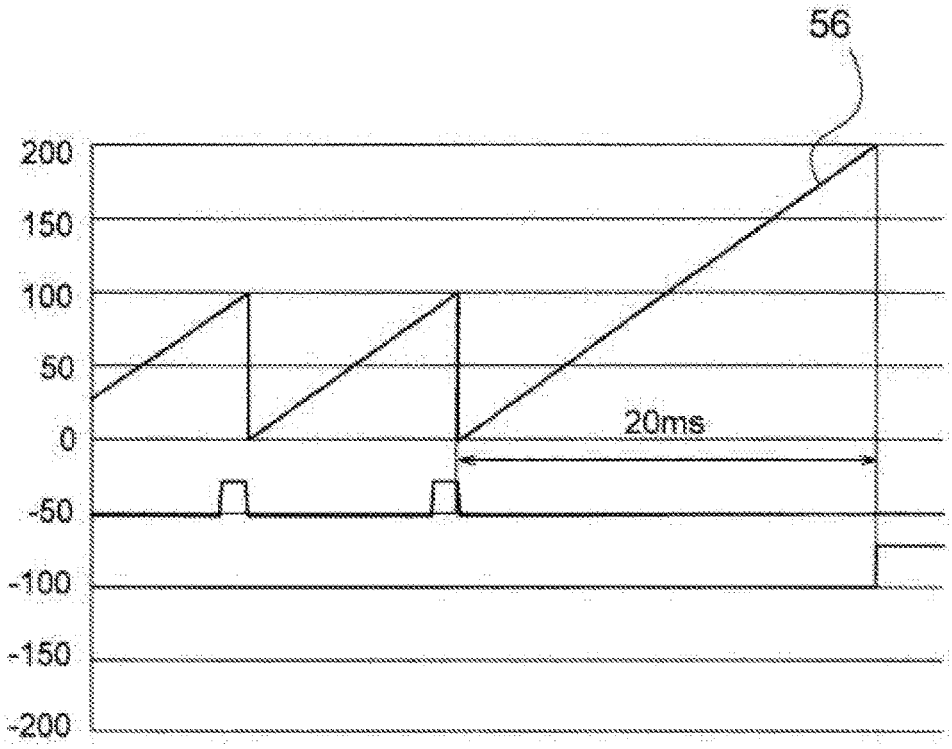
FIG. 11 is a graph for explaining a timer interrupt.

FIG. 10 is a flowchart illustrating a timer interrupt operation. The timer interrupt operation is an operation that is performed when an AC zero-cross point in the AC zero-cross signal input from the AC zero-cross circuit 130 is not detected for a predetermined period For example, as illustrated in FIG. 11, the input power failure judgement part 186 clears the counter in response to the interrupt of the falling edge of the AC zero-cross signal 56, and starts counting. When the interrupt of the falling edge of the AC zero-cross signal 56 is not entered in the predetermined period, the input power failure judgement part 186 determines that a counter overflow occurs, and performs AC zero-cross process in step S20. In an embodiment, a counter overflow setting as the predetermined period is set to 200 counts which corresponds to 20 ms. Note that the predetermined period is longer than one cycle of the AC zero-cross signal of the normal AC voltage, and is preferably not longer than two cycle of the AC zero-cross signal of the normal AC voltage. However, the predetermined period may be longer than two cycle of the AC zero-cross signal.

Here, the AC zero-cross process in step S20 is a process that monitors the pulse width of the AC zero-cross signal, and determines whether the pulse width of the AC zero-cross signal is abnormal. The AC zero-cross process in step S20 is described in detail later with reference to FIG. 14.

On the other hand, when the interrupt of the falling edge of the AC zero-cross signal 56 is entered in the predetermined period, the input power failure judgement part 186 does not perform the AC zero-cross process of step S20.

Figure 12:
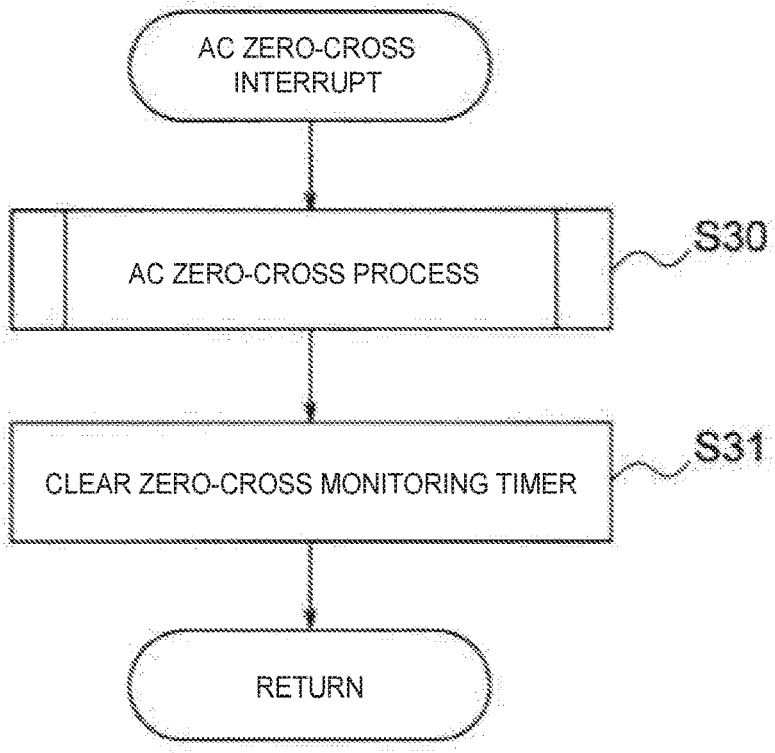
FIG. 12 is a flowchart of an AC zero-cross interrupt operation.

FIG. 12 is a flowchart of an operation of the AC zero-cross interrupt. The AC zero-cross interrupt is an operation that is performed when the interrupt of the falling edge of the AC zero-cross signal is detected within the predetermined period. When the interrupt of the falling edge of the AC zero-cross signal is detected within the predetermined period, the input power failure judgement part 186 executes the AC zero-cross process (step S30). The AC zero-cross process in step S30 is described in detail later with reference to FIG. 14.

Since the input power failure judgement part 186 detects the AC zero-cross interrupt, the input power failure judgement part 186 clears the zero-cross monitoring timer (step S31).

Figure 13:
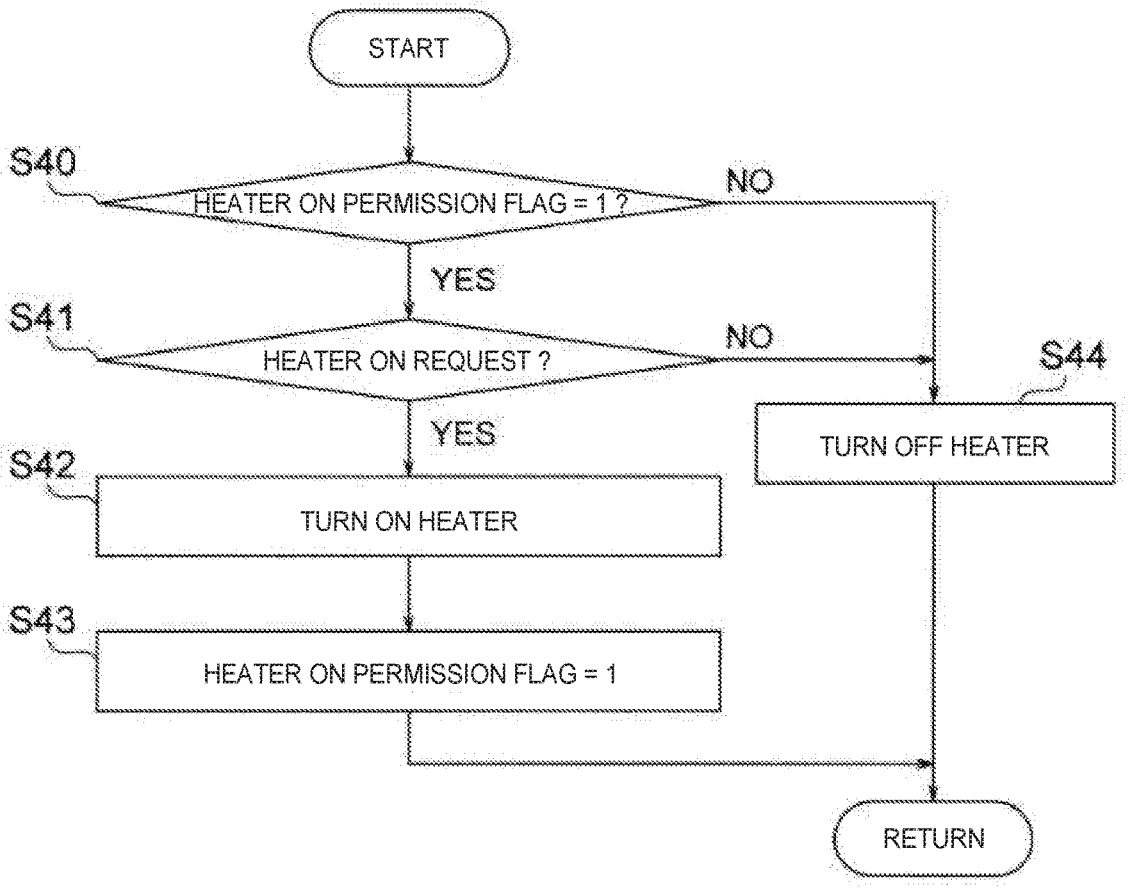
FIG. 13 is a flowchart of a temperature control of the heater 22.

FIG. 13 is a flowchart of the temperature control of the heater 22. The input power failure judgement part 186 determines whether or not the heater ON permission flag is "1" (step S40). When the heater ON permission flag is "1" (Yes in step S40), the process proceeds to step S41, and when the heater ON permission flag is "0" (No in step S40), the process proceeds to step S44.

In step S41, the input power failure judgement part 186 determines whether or not there is a heater ON request from the heater temperature controller 185. For example, the heater temperature controller 185 specifies the temperature of the heater 22 based on the detected value from a temperature sensor (not shown), and when the temperature does not reach a target value, sets the heater ON signal to the H level, to supply the heater ON request to the input power failure judgement part 186. When there is the heater ON request (Yes in step S41), the process proceeds to step S42, whereas there is no heater ON request (No in step S41), the process proceeds to step S44.

In step S42, the input power failure judgement part 186 sets, through the ACON connector, the heater ON signal to the H level, to turn on the heater 22 by means of the triac 134. Then, the input power failure judgement part 186 sets the heater ON flag to "1" (step S43).

On the other hand, in step S43, the input power failure judgement part 186 sets, through the ACON connector, the heater ON signal to the L level, to turn off the heater 22 by means of triac 134.

Figure 14:
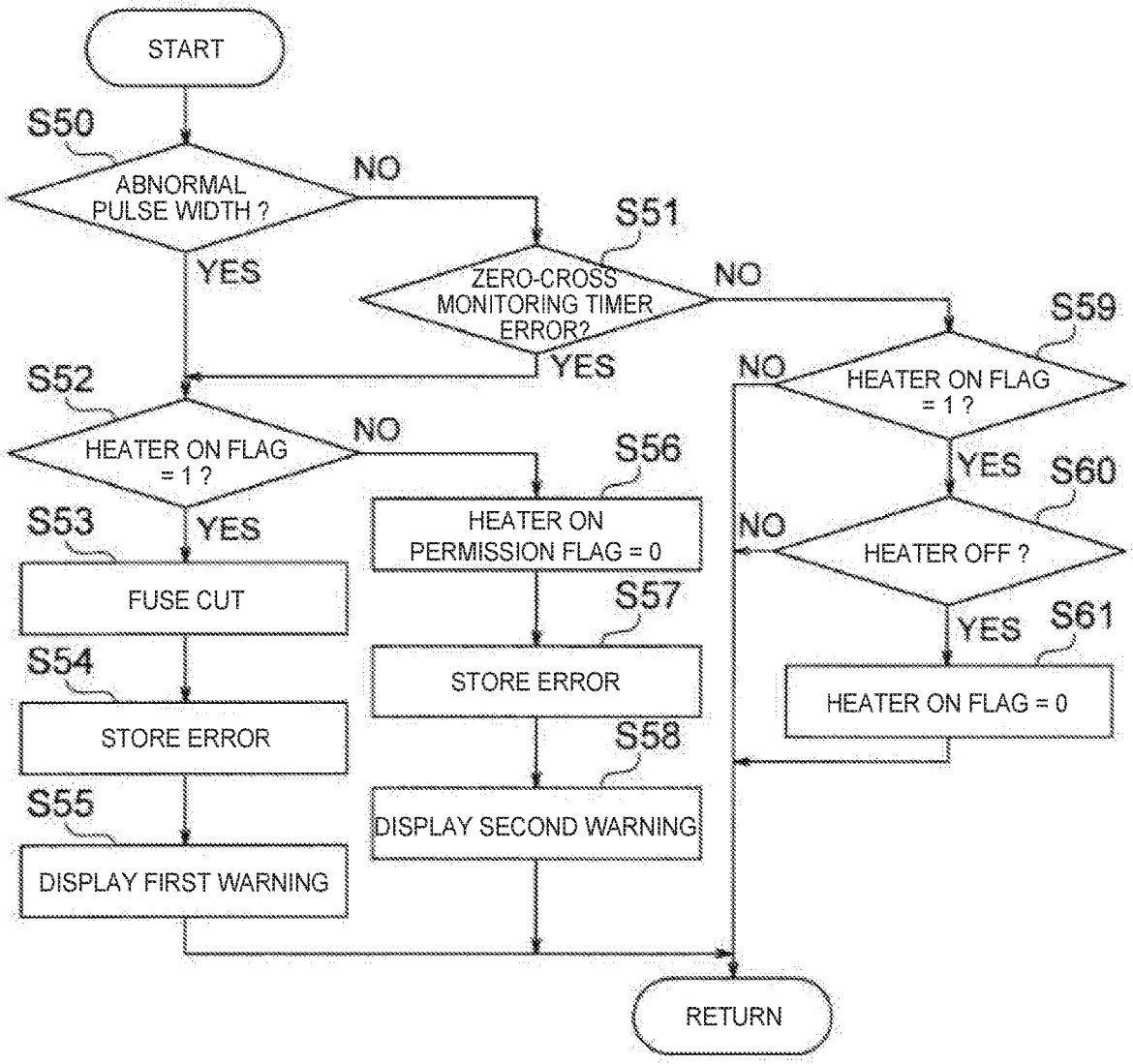
FIG. 14 is a flowchart of an AC zero-cross process.

FIG. 14 is a flowchart of the AC zero-cross process. First, the input power failure judgement part 186 determines whether the pulse width of the AC zero-cross signal transmitted from the AC zero-cross circuit 130 is abnormal or not (step S50). For example, the input power failure judgement part 186 specifies the pulse width of the H level of the AC zero-cross signal, and when the pulse width is less than the predetermined threshold, determines that the pulse width is abnormal. Note that, when the input power failure judgement part 186 cannot specify the pulse width (see for example, FIG. 8C), the input power failure judgement part 186 determines that the pulse width is not abnormal. When the pulse width is not abnormal (No in step S50, the process proceeds to step S51, whereas when the pulse width is abnormal (Yes in step S50), the process proceeds to step S52.

In step S51, the input power failure judgement part 186 determines whether there is a zero-cross monitoring timer error. For example, when the zero-cross monitoring timer has counted the predetermined period, the input power failure judgement part 186 determines that the zero-cross monitoring timer error is occurred. When the zero-cross monitoring timer error is occurred (Yes in step S51), the process proceeds to step S52, whereas when there is no zero-cross monitoring timer error (No in step S51), the process proceeds to step S59.

In step S52, the input power failure judgement part 186 determines whether the heater ON flag is "1" or not. When it is determined that the heater ON flag is "1" (Yes in step S52), the process proceeds to step S53, whereas when it is determined that the heater ON flag is "0" (No in step S52), the process proceeds to step S56.

In step S53, since it is determined in step S52 that the input AC waveform is abnormal in the state where the heater 22 is on, the input power failure judgement part 186 instructs the fuse cut process, so as to cut the fuse C 138*a* illustrated in FIG. 6. For example, the input power failure judgement part 186 changes, through the ERRdtc connector, the fuse cut signal to the H level, so as to instruct the protection operation part 129 to execute the fuse cut process.

Then, the input power failure judgement part 186 stores predetermined error information in the non-volatile storage 183 (step S54). The input power failure judgement part 186 instructs the display controller 182 to cause the display part 20 to display an error massage (step S55).

On the other hand, in step S56, since it is determined in step S52 that the input AC waveform is abnormal in the state where the heater 22 is off, the input power failure judgement part 186 sets the heater ON permission flag to "0" so that the heater 22 is not accidentally turned on.

Then, the input power failure judgement part 186 stores predetermined error information in the non-volatile storage 183 (step S57). The input power failure judgement part 186 instructs the display controller 182 to cause the display part 20 to display an error massage (step S58).

In step S59, since the input AC waveform is normal, the input power failure judgement part 186 determines whether the heater ON flag is "1" or not. When the heater ON flag is "1" (Yes in step S59), the process proceeds to step S60.

In step S60, the input power failure judgement part 186 determines whether the heater 22 is off. When the heater 22 is off (Yes in step S60), the process proceeds to step S61.

In step S61, the input power failure judgement part 186 sets the heater ON flag to "0".

Figure 15:
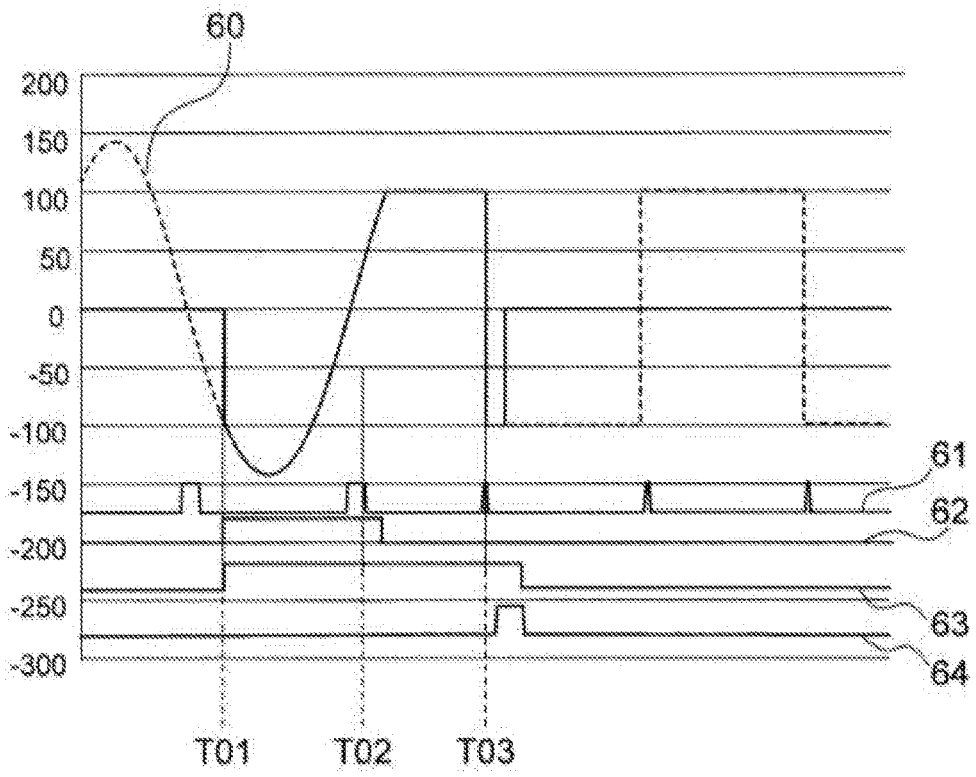
FIG. 15 is a graph illustrating a first example in which an AC input is changed from a normal sine wave to a square wave.
Figure 16:
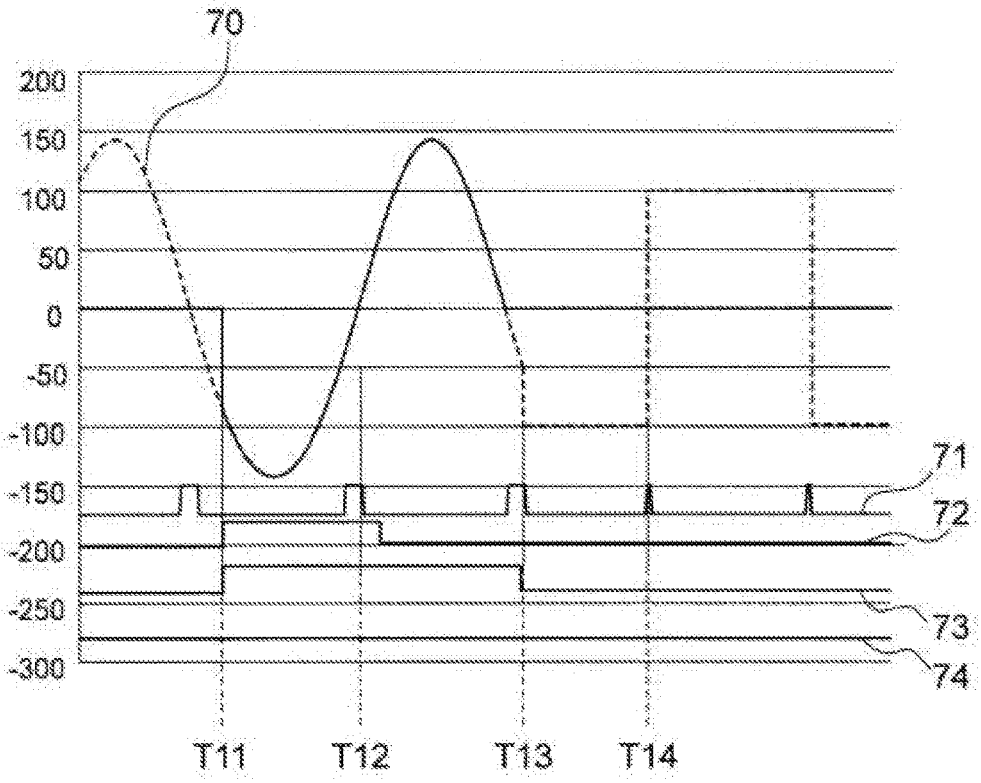
FIG. 16 is a graph illustrating a second example in which an AC input is changed from a normal sine wave to a square wave.
Figure 17:
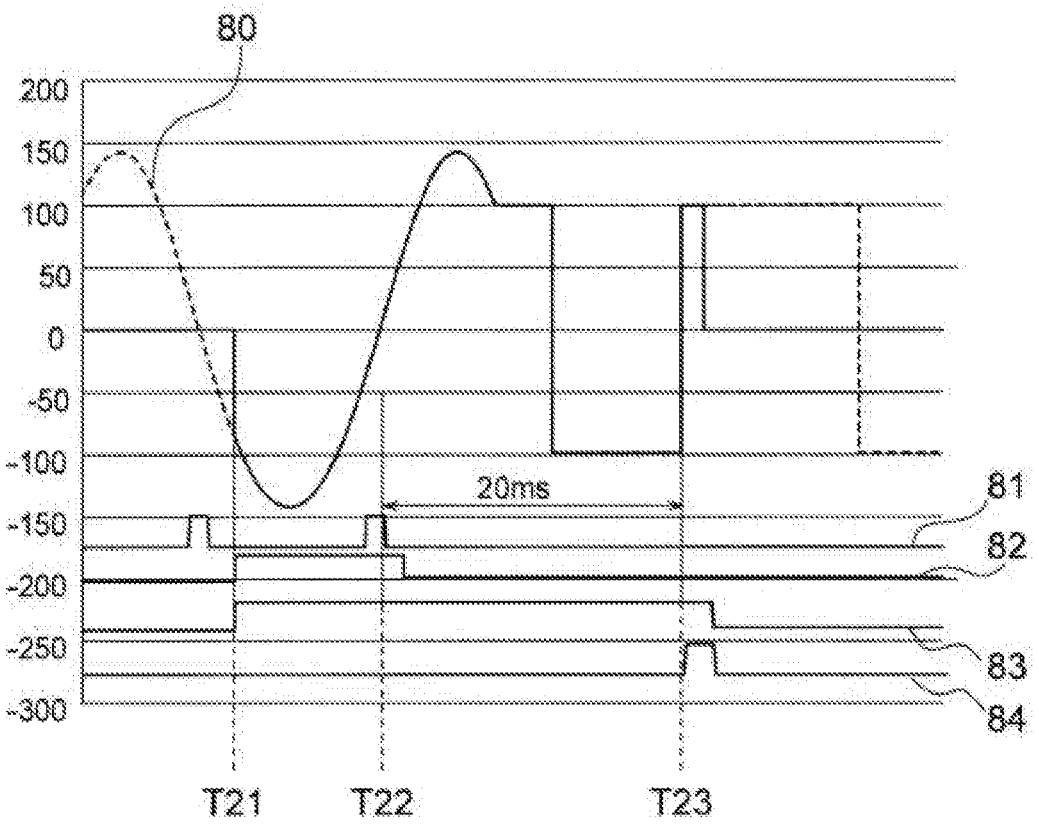
FIG. 17 is a graph illustrating a third example in which an AC input is changed from a normal sine wave to a square wave.

Hereinafter, specific examples of FIGS. 15 to 17 are explained with reference to the flowcharts illustrated in FIGS. 13 and 14. FIG. 15 is a graph for explaining a first example in which the AC input is changed from a normal sine wave to a square wave. In FIG. 15, the vertical axis represents the voltage and the horizontal axis represents the time. Further, in FIG. 15, the reference numeral 60 represents the power supply waveform, the reference numeral 61 represents the AC zero-cross signal, the reference numeral 62 represents the heater ON signal (H level/L level) output from the temperature control unit 185 to control the triac 134 to turn on and off the power supply to the heater 22, the reference numeral 63 represents the heater ON flag, and the reference numeral 64 represents the fuse cut signal. Note that the first example illustrated in FIG. 15 is an example in which after the AC input is changed to the abnormal square wave, the AC zero-cross interrupts are detected at the falling edges of the pulses of the zero-cross signal but the pulse width of the AC zero-cross signal becomes less than 500 us.

At time T01, if there is the heater ON request from the heater temperature controller 185 for the power supply waveform 60 in the heater temperature control (Yes in S41 in FIG. 13), the input power failure judgement part 186 turns on the heater 22 (step S42 in FIG. 13). At this time, the heater ON signal is transitioned to the H level (as indicated by the reference numeral 62 in FIG. 15), and the heater ON flag is set to "1" (as indicated by the reference numeral 63 in FIG. 15).

Next, at time T02 when the AC zero-cross interrupt occurs, the determination step (step S50 in FIG. 14) of determining whether or not the pulse width is abnormal is first executed. In step S50 in FIG. 14, it is determined that the pulse width is 1 ms and thus is not abnormal, and thus the process proceeds to step S51 in FIG. 14.

In step S51 in FIG. 14, since the AC zero-cross interrupt is input normally, the input power failure judgement part 186 determines no zero-cross monitoring timer error (No in step S51), and thus the process proceeds to step S59 in FIG. 14.

In step S59 in FIG. 14, it is determined that the heater ON flag is "1" as illustrated by the heater ON flag 63 in FIG. 15. Then, in step S60, it is determined that the heater 22 is not turned off, and thus the heater 22 is kept on and then the zero-cross interrupt process is terminated.

At time T03 when the next AC zero-cross interrupt occurs, it is determined that the pulse the pulse width is 500 μs and abnormal (step S50 in FIG. 14), and thus the process proceeds to step S52.

In step S52 in FIG. 14, as illustrated by the heater ON flag 63 in FIG. 15, it is determined that the heater ON flag is "1", and thus the process proceeds to step S53. In step S53 in FIG. 14, the input power failure judgement part 186 sets the fuse cut signal 64 to the H level, to cause the protection operation part 129 to cut the fuse C 138*a*.

Further, the input power failure judgement part 186 stores predetermined error information into the non-volatile storage 183 (step S54 in FIG. 14), and displays the error massage on the display part 20 (step S55 in FIG. 14).

FIG. 16 is a graph illustrating a second example in which the AC input is changed to from a normal sine wave to a square wave. In FIG. 16, the vertical axis represents the voltage and the horizontal axis represents the time. Further, in FIG. 16, the reference numeral 70 represents the power supply waveform, the reference numeral 71 represents the AC zero-cross signal, the reference numeral 72 represents the heater ON signal (H level/L level), the reference numeral 73 represents the heater ON flag, and the reference numeral 74 represents the fuse cut signal. Note that the second example illustrated in FIG. 16 is an example in which after the heater 22 is turned off, the AC zero-cross interrupts are detected at the falling edges of the pulses of the zero-cross signal, but the pulse width becomes abnormal.

At time T11, if there is the heater ON request from the heater temperature controller 185 for the power supply waveform 70 in the heater temperature control (Yes in S41 in FIG. 13), the input power failure judgement part 186 turns on the heater (step S42 in FIG. 13). At this time, the heater ON signal is transitioned to the H level as indicated by the reference numeral 72 in FIG. 16, and the heater ON flag is set to "1" as indicated by the reference numeral 73 in FIG. 16.

Next, at time T12 when the next AC zero-cross interrupt occurs, the determination step (step S50 in FIG. 14) of determining whether or not the pulse width is abnormal is first executed. In step 50 in FIG. 14, it is determined that the pulse width is 1 ms and thus is not abnormal (No in step S50), and thus the process proceeds to step S51 in FIG. 14.

In step S51 in FIG. 14, since the AC zero-cross interrupt is input normally, the input power failure judgement part 186 determines no zero-cross monitoring timer error (No in step S51), and thus the process proceeds to step S59 in FIG. 14.

In step S59 in FIG. 14, it is determined that the heater ON flag is "1" as indicated by the heater ON flag 73 in FIG. 16. In step S60, it is determined that the heater 22 is not turned off, and thus the heater 22 is kept on and then the zero-cross interrupt process is terminated.

At time T13 when the next AC zero-cross interrupt occurs, it is determined that the pulse width is 1 ms and is not abnormal (step S50 in FIG. 14), and it is determined that there is no zero-cross monitoring timer error (step S51 in FIG. 14), and then the process proceeds to step S59 in FIG. 14.

In step S59 in FIG. 14, as indicated by the heater ON flag 73 in FIG. 16, it is determined that the heater ON flag is "1" (Yes in step S59 in FIG. 14). However, it is determined that the heater 22 is turned off (Yes in step S60 in FIG. 14), and thus, the heater ON flag is set to "0" (step S61 in FIG. 14) as indicated by the reference numeral 73 in FIG. 16.

At time T14 when the next AC zero-cross interrupt occurs, in step S50 in FIG. 14, it is determined that the pulse width is 500 μs and is abnormal, and thus the process proceeds to step S52 in FIG. 14.

In step S52 in FIG. 14, as illustrated by the heater ON flag 73 in FIG. 15, it is determined that the heater ON flag is "0", the process proceeds to step S56. In step S56 in FIG. 14, the input power failure judgement part 186 sets the heater ON permission flag to "0", so as to prevent the heater 22 from being accidentally turned on.

Then, the input power failure judgement part 186 stores the error information into the non-volatile storage 183 (step S57), and displays the error massage on the display part 20 (step S58). In this case, the fuse cut signal is never turned on.

FIG. 17 is a graph illustrating a third example in which the AC input is changed from a normal sine wave to a square wave. In FIG. 17, the vertical axis represents the voltage and the horizontal axis represents the time. Further, in FIG. 17, the reference numeral 80 represents the power supply waveform, the reference numeral 81 represents the AC zero-cross signal, the reference numeral 82 represents the heater ON signal (H level/L level), the reference numeral 83 represents the heater ON flag, and the reference numeral 74 represents the fuse cut signal. Note that the third example illustrated in FIG. 17 is an example in which after the AC input is changed to the abnormal square wave, the AC zero-cross interrupts are not detected.

At time T21, if there is the heater ON request from the heater temperature controller 185 for the power supply waveform 80 in the heater temperature control (Yes in S41 in FIG. 13), the input power failure judgement part 186 turns on the heater 22 (step S42 in FIG. 13). At this time, the heater ON signal is transitioned to the H level as indicated by the reference numeral 82 in FIG. 17, and the heater ON flag is set to "1" as indicated by the reference numeral 83 in FIG. 17.

At time T22 when the next AC zero-cross interrupt occurs, the determination step (step S50 in FIG. 14) of determining whether or not the pulse width is abnormal is first executed. In step S50 in FIG. 40, it is determined that the pulse width is 1 ms and not abnormal (No in step S50), and thus the process proceeds to step S51 in FIG. 14.

In step S51 in FIG. 14, since the AC zero-cross interrupt is input normally, the input power failure judgement part 186 determines there is no zero-cross monitoring timer error (No in step S51), and thus the process proceeds to Step S59 in FIG. 14.

In step S59 in FIG. 14, as indicated by the heater ON flag 83 in FIG. 17, it is determined that the heater ON flag is "1" (Yes in step S59 in FIG. 14). Then, in step S60, it is determined that the heater 22 is not turned off (No in step S60), and thus the heater 22 is kept on and the zero-cross interrupt process is terminated.

After that, as illustrated in FIG. 17, the power supply waveform 80 is changed to a square wave and thus no zero-cross interrupt is entered. At time T23, the AC zero-cross process in step S20 in FIG. 10 is executed in response to the timer interrupt due to the overflow of the zero-cross monitoring timer.

In step S50 in FIG. 14 of determining whether or not the pulse width is abnormal, since no pulse width is detected, it is determined that the pulse width is not abnormal (No in step S50), and thus the process proceeds to step S51. In step S51 in FIG. 14, since there is the zero-cross monitoring timer error (Yes in step S51), the process proceeds to step S52.

In step S52 in FIG. 14, as illustrated by the heater ON flag 83 in FIG. 17, it is determined that the heater ON flag is "1" (Yes in step S52), the process proceeds to step S53. In step S53 in FIG. 14, the input power failure judgement part 186 sets the fuse cut signal 84 to the H level, to cause the protection operation part 129 to cut the fuse C 138*a*.

Further, the input power failure judgement part 186 stores the predetermined error information into the non-volatile storage 183 (step S54 in FIG. 14), and displays the error massage on the display part 20 (step S55 in FIG. 14).

Note that the above described operation in the example where the AC zero-cross interrupts are not detected as illustrated in FIG. 17 is applicable not only when a square wave is input, but also when a DC is input, or a DC and an AC superimposed on each other are input.

According to one or more embodiments described above, the fuse C 138*a* is cut off as long as the input AC voltage waveform becomes abnormal in the state where the heater 22 is turned on. Accordingly, this prevents the fuse C 138*a* from being unintentionally cut even though the operation of the triac 134 is turned off. Therefore, when the normal AC input is restored, the recovery becomes easier. Note that here it is determined that the waveform of the input AC voltage is abnormal when the input AC voltage become a square wave.

The above descried one or more embodiments are applicable to any apparatus including a fixation device such as a printer, a facsimile device, a multi-function printer, or the like.

Note that in a case of an apparatus in which a halogen lamp is used for the heater 22 of the fixation device 11, a zero-cross detection circuit is used in the phase control with reference to an AC zero-cross signal thereof to suppress inrush currents, thus the AC zero-cross signal may be shared.

In one or more embodiments described above, when it is determined that the waveform of the input voltage is abnormal and the triac 134 turns on the heater 22, the input power failure judgement part 186 instructs the protection operation part 129 to executes the fuse cut. However, the invention is not limited to this. For example, when it is determined that the waveform of the input voltage is abnormal, the input power failure judgement part 186 may instruct the protection operation part 129 to executes the fuse cut.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation apparatus, comprising:

a heater that heats a medium on which a developer image is formed;

a controller that controls the heater;

a first path through which an input voltage, which is an alternating current (AC) voltage input from an external power supply, is converted to a predetermined voltage, and the predetermined voltage is supplied to the controller;

a second path which is branched from the first path and through which the input voltage is supplied to the heater;

an AC zero-cross detector that detects an AC zero-cross point of the input voltage;

a control element which is connected to the second path and controls on/off switching of the heater in response to an instruction from the controller; and a disconnection part that disconnects the second path when the controller determines that a waveform of the input voltage is abnormal, wherein the controller determines the waveform of the input voltage is abnormal in response to a length of time when the AC zero-cross point is detected being shorter than a predetermined threshold, or in response to no AC zero-cross point being detected.

2. The image formation apparatus according to claim 1, wherein the disconnection part disconnects the second path when it is determined that the waveform of the input voltage is abnormal and the control element has the heater turned on.

3. The image formation apparatus according to claim 2, wherein when it is determined that the waveform of the input voltage is abnormal and the control element has the heater turned off, the controller does not cause the control element to turn on the heater and the disconnection part does not disconnect the second path.

4. The image formation apparatus according to claim 1, wherein the control element comprises a triac.

5. The image formation apparatus according to claim 1, wherein the AC zero-cross detector is configured to output a pulse having a width corresponding to the length of time when the AC zero-cross point of the input voltage is detected, and wherein the controller determines the waveform of the input voltage is abnormal when the width of the output pulse is shorter than the predetermined threshold, or when no pulse is detected within a predetermined period of time.

6. The image formation apparatus according to claim 1, wherein the AC zero-cross detector includes a photocoupler that detects the AC zero-cross point of the input voltage.

* * * * *